United States Patent [19]

Manoly

[11] Patent Number: 4,712,293

[45] Date of Patent: Dec. 15, 1987

[54] METHOD FOR SECURING A SLOW-WAVE STRUCTURE IN ENVELOPING STRUCTURE WITH CRIMPED SPACERS

[75] Inventor: Arthur E. Manoly, Rancho Palos Verdes, Calif.

[73] Assignee: Hughes Aircraft Company, Los Angeles, Calif.

[21] Appl. No.: 935,871

[22] Filed: Nov. 28, 1986

[51] Int. Cl.[4] ..... H01P 11/00; H01Q 13/00

[52] U.S. Cl. ..... 29/600; 315/3.5; 315/5.35

[58] Field of Search ..... 29/600, 601; 315/3.5, 315/3.6, 5.35

[56] References Cited

U.S. PATENT DOCUMENTS

| | | | |
|---|---|---|---|
| 2,943,228 | 6/1960 | Kleinman | 29/600 |
| 3,308,399 | 3/1967 | Drees et al. | 29/600 |
| 3,374,388 | 3/1968 | Huber | 315/3.5 |
| 3,475,643 | 10/1969 | Schrager et al. | 29/600 |
| 3,514,843 | 6/1970 | Cernik | 29/559 |
| 3,540,119 | 11/1970 | Manoly | 29/600 |
| 3,691,630 | 9/1972 | Burgess et al. | 29/600 |
| 3,949,263 | 4/1976 | Harper | 315/3.5 |
| 4,270,070 | 5/1981 | Gross | 315/3.5 |

*Primary Examiner*—David K. Moore
*Assistant Examiner*—Mark R. Powell
*Attorney, Agent, or Firm*—Paul M. Coble; A. W. Karambelas

[57] ABSTRACT

A plurality of longitudinally disposed dielectric support rods are attached to the outer circumferential surface of a helical slow-wave structure to form a subassembly. The subassembly is mounted in a light press-fit relationship within an enveloping structure comprising a plurality of annular nonmagnetic spacer elements repectively interposed between and abutting a plurality of annular ferromagnetic pole pieces. Plastically deforming force is applied by means of a pair of dies to the outer surface of the spacer elements to crimp the spacer elements onto the support rods and thereby firmly hold the slow-wave structure-rod subassembly within the enveloping structure.

15 Claims, 5 Drawing Figures

METHOD FOR SECURING A SLOW-WAVE STRUCTURE IN ENVELOPING STRUCTURE WITH CRIMPED SPACERS

TECHNICAL FIELD

This invention relates to traveling-wave tubes, and more particularly it relates to a method for securing a traveling-wave tube slow-wave structure within an enveloping structure.

BACKGROUND OF THE INVENTION

In electron beam tubes of the traveling-wave type, a stream of electrons is caused to interact with a propagating electromagnetic wave in a manner which amplifies the electromagnetic wave. In order to achieve the desired interaction, the electromagnetic wave is propagated along a slow-wave structure, such as an electrically conductive helix wound about the path of the electron stream. The slow-wave structure provides a path of propagation for the electromagnetic wave which is considerably longer than the axial length of the structure so that the traveling-wave may be made to effectively propagate at nearly the velocity of the electron stream. Slow-wave structures of the helix type are usually supported within an encasing barrel by means of a plurality of equally circumferentially spaced electrically insulating rods disposed between the helix and the barrel.

One method which has been employed to mount a helical slow-wave structure and its support rods within an encasing barrel, termed "triangulation", involves making the barrel in the form of a resilient tubular metallic clamp. The cross-section of the clamp is initially circular, with a cross-sectional area greater than that of the structure-rod subassembly to be inserted within the clamp, but with a normal diameter which is less than that of a circle circumscribing the structure-rod subassembly. The clamp is first distorted by applying forces to three points equally spaced along the circumference of the clamp to alter its cross-section from circular toward triangular and thereby produce a configuration which more closely conforms to that of the structure-rod subassembly. The structure-rod subassembly is then inserted into the distorted clamp with the rods intermediate the points of application of the forces. Upon removal of the distorting forces, the clamp restores itself toward its original shape and in so doing compresses the rods and the slow-wave structure into a rigid assembly. Further details regarding such triangulation techniques may be found in U.S. Pat. Nos. 2,943,228 to Bernard Kleinman and 3,514,843 to George Cernik.

Another technique which has been employed to mount a helical slow-wave structure and its support rods within an encasing barrel involves "heat-shrinking" the barrel. The barrel is heated to an elevated temperature, causing its inner circumference to expand. The subassembly of the helical slow-wave structure and its support rods are inserted into the barrel while the barrel is maintained at an elevated temperature. The barrel is then allowed to cool, causing it to shrink around the subassembly and to provide a tight interference fit with the support rods. For further details concerning such heat shrinking techniques, reference may be made to U.S. Pat. No. 3,540,119 to Arthur E. Manoly.

As traveling-wave tube operating frequencies have increased, required dimensions for slow-wave structures employed in such tubes have become smaller and smaller. Although the above-described methods of triangulation and heat shrinking are useful for securing larger-sized slow-wave structures in an encasing barrel, these methods have not been completely satisfactory for smaller-sized slow-wave structures, such as those operating at millimeter wavelengths.

A method which has been successfully employed to secure small-sized helical slow-wave structure-support rod subassemblies in an encasing barrel involves the "precision coining" of the subassembly. In this method a helical slow-wave structure is mounted between at least three support rods having a given circumscribing circular dimension. The slow-wave structure with its support rods are inserted into a tubular barrel having an interior diameter greater than the diameter of the circumscribing circular dimension. The barrel is malleably deformed so that its interior size is reduced to a diameter less than that of the circumscribing circular dimension to engage the support rods which in turn resiliently compress and deform the helical slowwave structure such that the compressed helical slowwave structure maintains a return force on the rods to firmly hold the helical slow-wave structure and support rods within the barrel. The precision coining technique is disclosed and claimed in co-pending application of George M. Lee, Ser. No. 789,882, filed Oct. 21, 1985, and assigned to the assignee of the present invention; now abandoned.

SUMMARY OF THE INVENTION

It is an object of the present invention to provide a method for securing a slow-wave structure for a traveling-wave tube within an enveloping structure which retains the advantages of the aforementioned precision coining technique and at the same time eliminates the need for a separate encasing barrel and its interface, provides a larger magnetic field along the slow-wave structure axis for the same amount of magnetic material, and more readily facilitates vacuum pumping of the tube.

It is a further object of the invention to provide a method for securing a traveling-wave tube slow-wave structure within an enveloping structure which achieves enhanced heat removal from the slow-wave structure, more secure clamping with the same tolerances, and substantially higher manufacturing yield than has been afforded with triangulation and heat shrinking techniques.

It is still another object of the invention to provide a method for securing a traveling-wave tube slow-wave structure within an enveloping structure which is especially suitable for small slow-wave structures designed to operate at millimeter wavelengths.

In a method according to the invention a plurality of longitudinally disposed dielectric rods are attached to the outer surface of a slow-wave structure to form a subassembly. The subassembly is mounted within an enveloping structure comprising a plurality of annular nonmagnetic spacer elements respectively interposed between and abutting a plurality of annular ferromagnetic disks. The spacer elements and the pole pieces are coaxially disposed with the inner surfaces of the spacer elements and the disks defining a cylindrical surface of a diameter sufficient to receive the slow-wave structure-rod subassembly. Plastically deforming force is applied to the outer surface of the spacer elements to crimp the spacer elements onto the dielectric rods and thereby firmly hold the slow-wave structure-rod subassembly within the enveloping structure.

Additional objects, advantages, and characteristic features of the present invention will become readily apparent from the following detailed description of a preferred embodiment of the invention when considered in conjuntion with the accompanying drawings.

DETAILED DESCRIPTION OF THE INVENTION

Figure 1:
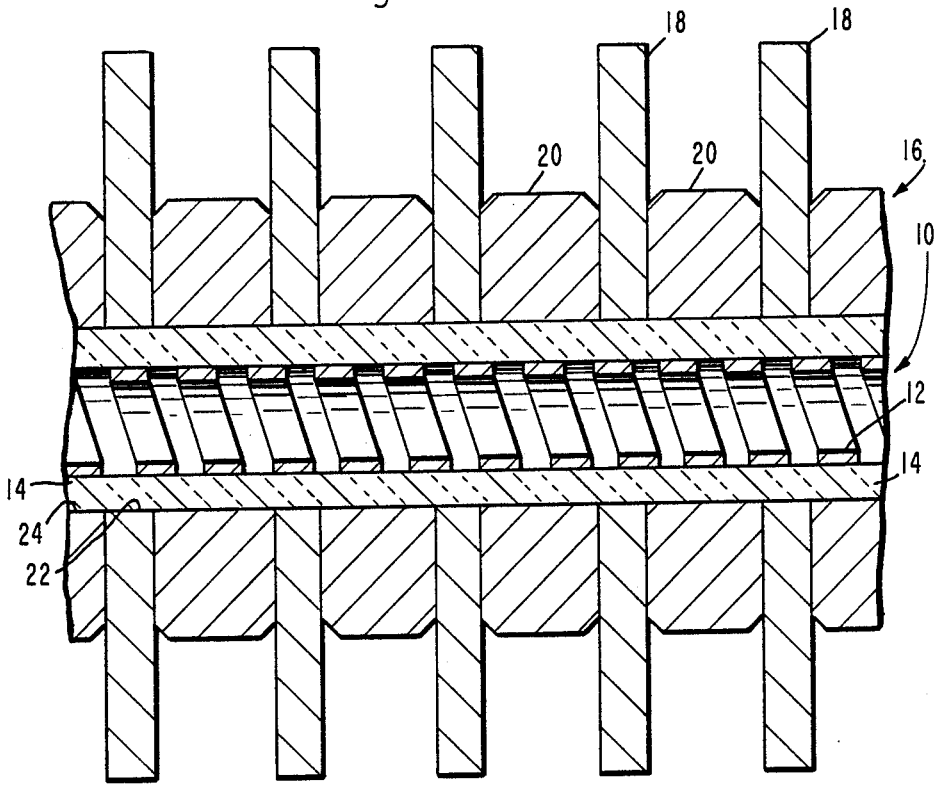
FIG. 1 is a longitudinal sectional view illustrating a slow-wave structure-support rod subassembly inserted into an enveloping pole piece-spacer structure at an intermediate stage of fabrication in a method according to the invention.

Referring to FIG. 1 with greater particularity, there is shown a subassembly 10 comprising a helical slow-wave structure 12 mounted on a plurality of longitudinally extending dielectric support rods 14 inserted within an enveloping structure 16. The helical slow-wave structure 12 may be of a metal such as tungsten, while the support rods 14 may be of a dielectric material such as beryllia, diamond, or anisotropic boron nitride. The rods 14 are equally circumferentially spaced along the outer circumferential surface of the helical slow-wave structure 12 and extend longitudinally along the structure 12 in a direction parallel to the axis of the structure 12. Although a preferred embodiment of the invention described herein employs four support rods 14 spaced along the circumference of the helical slow-wave structure 12 at 90° intervals, other numbers and orientations of support rods, such as three rods spaced at 120° intervals, are also suitable and may be employed. Moreover, although the rods 14 are disclosed as having a substantially rectangular cross-section (in practice the surfaces of the rods 14 in contact with the slow-wave structure 12 and the enveloping structure 16 may be curved slightly to conform to the surfaces which they contact), other cross-sectional configurations may be employed instead.

The enveloping structure 16 for the slow-wave structure subassembly 10 comprises a plurality of spaced coaxially disposed annular ferromagnetic disk-shaped pole pieces 18. An annular non-magnetic spacer element 20 is coaxially disposed between and abuts each pair of adjacent pole pieces 18. The pole pieces 18 are of a ferromagnetic material such as iron, while the spacer elements 20 are of a non-magnetic material such as dispersion-strengthened copper or a nickel-copper alloy. The inner circumferential surfaces 22 and 24 of the pole pieces 18 and the spacer elements 20, respectively, are aligned with one another and together define a cylindrical surface of a diameter sufficient to snuggly receive the slow-wave structure subassembly 10. Thus, when the subassembly 10 is inserted within the enveloping structure 16, the outer surfaces of the support rods 14 contact the inner surfaces of the pole pieces 18 and the spacer elements 20 in a light press-fit relationship. As shown in FIG. 1, the radial extent of the spacer elements 20 is substantially less than that of the pole pieces 18 in order to accommodate a plurality of permanent magnets (not shown) between respective adjacent pairs of pole pieces 18 and thereby provide a periodic permanent magnetic focusing arrangement for the traveling-wave tube in which the assembly of FIG. 1 is used.

Figure 2:
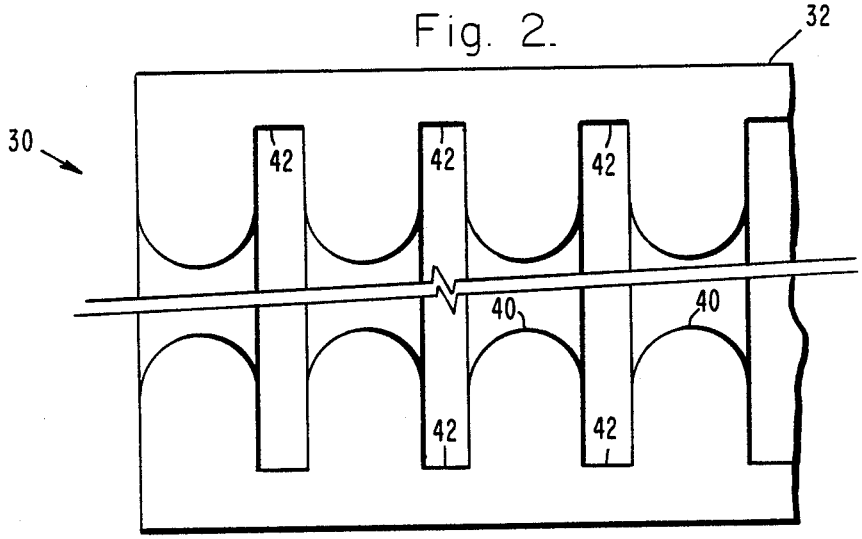
FIG. 2 is a longitudinal view illustrating one die of crimping apparatus which may be employed in carrying out the method of the invention.
Figure 3:
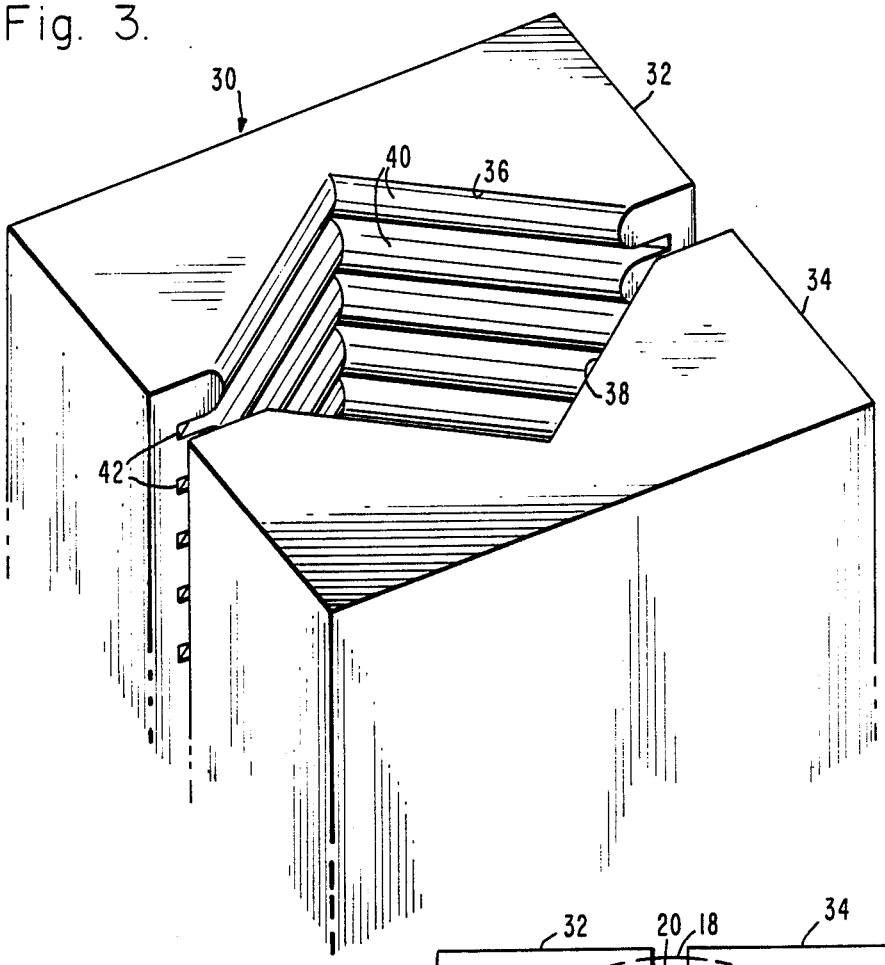
FIG. 3 is perspective view of the apparatus of FIG. 2.

FIGS. 2 and 3 illustrate an exemplary press 30 which may be employed in carrying out a crimping operation on the assembly of FIG. 1 in accordance with the present invention. The arrangement of FIGS. 2–3 is particularly suitable for processing slow-wave structure subassemblies in which four support rods 14 are provided at 90° intervals around the circumference of the slow-wave structure 12. It should be understood, however, that the press 30 may be employed with slow-wave structure assemblies having different support rod numbers and configurations; or, alternatively, the press configuration may be modified to more closely conform to the particular support rod arrangement being processed.

The press 30 of FIGS. 2–3 is constructed in the form of a pair of opposing moveable dies 32 and 34. The facing inner surfaces of the respective dies 32 and 34 are recessed in a manner defining like half-cavities 36 and 38 of a substantially right angular cross-section. Each wall of the half-cavities 36 and 38 defines along the length of dies 32 and 34 a plurality of transversely disposed semicylindrical projections 40 respectively interposed between a plurality of recessed portions 42. The recessed portions 42 are dimensioned to accommodate respective pole pieces 18, while the projections 40 form tool surfaces which crimpingly engage the outer circumferential surfaces of respective spacer elements 20 when the assembly of FIG. 1 is inserted into the press 30 and the dies 32 and 34 are contracted.

Figure 4:
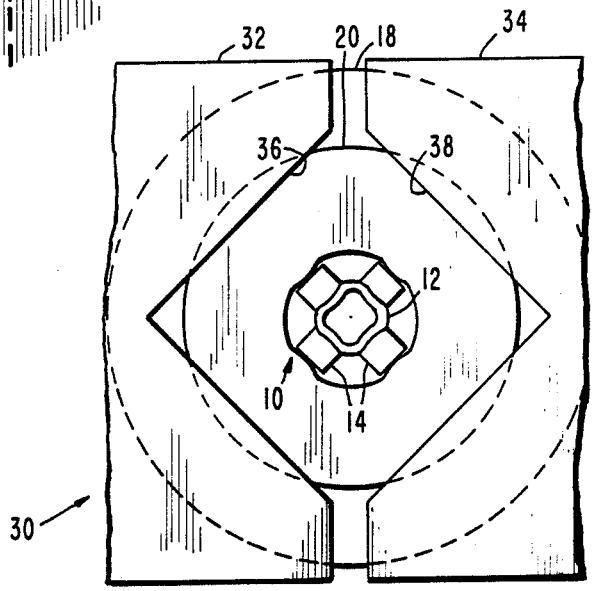
FIG. 4 is a cross-sectional view illustrating the assembly of FIG. 1 within the apparatus of FIGS. 2–3 at the completion of the crimping step in the method of the invention.

FIG. 4 illustrates the assembly of FIG. 1 inserted within the press 30 and with the dies 32 and 34 contracted sufficiently to perform a crimping operation on the slow-wave structure subassembly 10. As shown in FIG. 4 slow-wave structure 12 is preferably oriented so that the rods 14 extend radially outwardly from the slow-wave struture 12 in directions substantially perpendicular to the respective portions of the surfaces of the dies 32 and 34 that contact the rods 14.

In carrying out the method of the invention, the slow-wave structure subassembly 10 is formed by attaching the support rods 12 to the outer circumferential surface of the slow-wave structure 12. The rods 14 preferably are attached to the slow-wave structure by gluing, a suitable glue being methyl methacrylate. The enveloping structure 16 is fabricated by securing the interposed pole pieces 18 and spacer elements 20 to one another, preferably by brazing. The slow-wave structure subassembly 12 is then inserted into the enveloping structure 16 as shown in FIG. 1.

Next, the assembly of FIG. 1 is inserted within the press 30 such that the pole pieces 18 reside in the die recessed portions 42 and the die projections 40 are disposed adjacent to the outer circumferential surfaces of respective spacer elements 20. The dies 32 and 34 are then contracted so that sufficient force is applied to the portions of the outer circumferential surfaces of the spacer elements 20 contacted by the die projections 40 to plastically deform the spacer elements and thereby crimp them onto the support rods 14. As shown in FIG. 4, the rods 14 are driven radially inwardly and deform the cross-sectional configuration of the slow-wave structure 12. It should be noted that the degree of deformation is exaggerated in FIG. 4 for the purpose of illustrating the invention; in actual practice, however, the degree of deformation is much smaller than that shown. The result of the crimping operation is to firmly hold the helical slow-wave structure 12 and its support rods 14 within the enveloping structure 16. The glue between the structure 12 and the rods 14 may now be removed, for example, by flushing with hot acetone when methyl methacrylate glue is employed.

It is pointed out that in contrast to a coining operation, the dies 32 and 34 are never completely closed. Thus, whereas in a coining operation, plastic flow of the coined material results in a change in size but not in shape, in a crimping operation the material is deformed and changes its shape without any substantial affect on its size. Moreover, in contrast to triangulation wherein the elastic deformation limit of the material is not exceeded so that the material returns to its original shape after the distorting force has been removed, the crimping force exceeds the elastic deformation limit of the material so that permanent plastic deformation of the material occurs.

Figure 5:
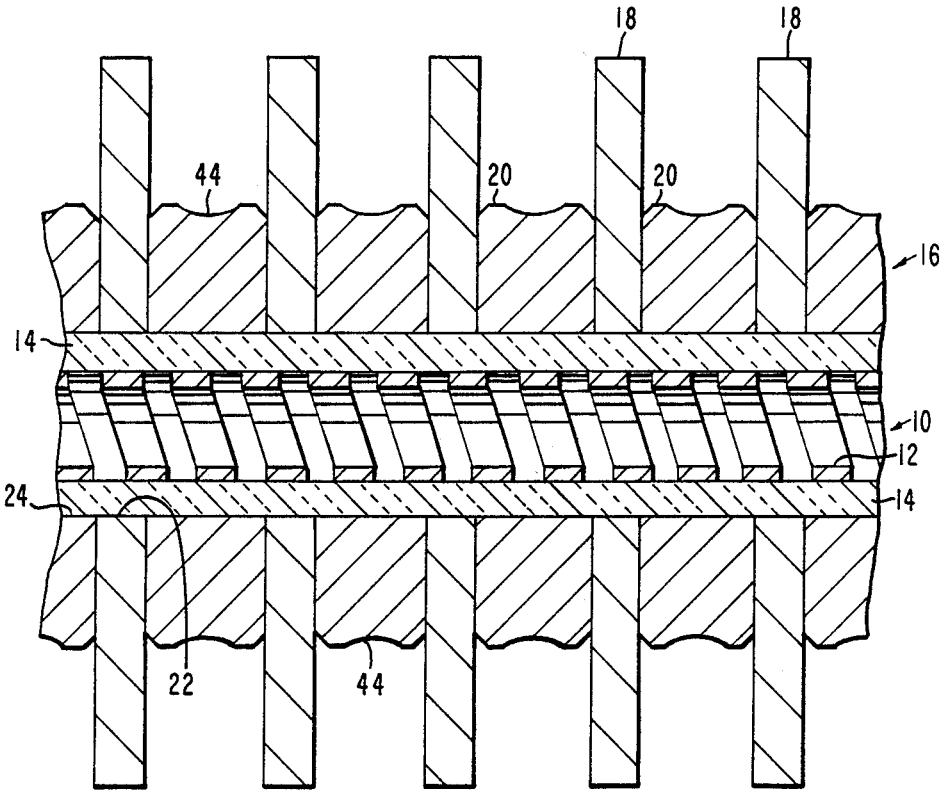
FIG. 5 is a longitudinal sectional view of the assembly of FIG. 1 after completion of the crimping step.

After completion of the crimping operation, the resultant assembly is illustrated in FIG. 5. The spacer elements 20 are crimped onto the support rods 14 to firmly hold the rods 14 and the helical slow-wave structure 12 in position within the enveloping structure 16. Note that as a result of the crimping force, permanent indentations 44 are formed in the respective outer circumferential surfaces of the spacer elements 20.

Since excellent thermal contact is achieved between the rods 14 and the spacer elements 20 as well as between the rods 14 and the slow-wave structure 12, the invention enables heat removal from the slow-wave structure 12 to be enhanced. In addition, more secure clamping with the same tolerances and an increase in manufacturing yield by a factor of four is achieved compared to triangulation and heat-shrinking techniques. Moreover, since the present invention eliminates the need for a separate encasing barrel, the magnetic focusing structure may be moved closer to the slow-wave structure, resulting in a larger magnetic field along the slow-wave structure axis for the same amount of magnetic material. Also, by eliminating the barrel-focusing structure interface vacuum pumping of the traveling-wave tube is facilitated.

Although the present invention has been shown and described with reference to a particular embodiment, nevertheless, various changes and modifications which are obvious to a person skilled in the art to which the invention pertains are deemed to lie within the spirit, scope, and contemplation of the invention.

What is claimed is:

1. A method for securing a slow-wave structure for a traveling-wave tube within an enveloping structure comprising the steps of:

attaching a plurality of longitudinally disposed dielectric rods to the outer surface of said slow-wave structure to form a subassembly, mounting said subassembly within an enveloping structure comprising a plurality of annular non-magnetic spacer elements respectively interposed between and abutting a plurality of annular ferromagnetic disks, said spacer elements and said disks being coaxially disposed with the inner surfaces of said spacer elements and said disks defining a cylindrical surface of a diameter sufficient to receive said subassembly, and applying plastically deforming force to the outer surface of said spacer elements to crimp said spacer elements onto said dielectric rods and thereby firmly hold said subassembly within said enveloping structure.

2. A method according to claim 1 wherein said dielectric rods are attached to said slow-wave structure by means of glue which is removed after the plastic deformation step.

3. A method according to claim 1 wherein said dielectric rods have a substantially rectangular cross-section.

4. A method according to claim 1 wherein said spacer elements and said ferromagnetic disks are brazed to one another.

5. A method according to claim 1 wherein said slow-wave structure is of tungsten, said dielectric rods are of a material selected from the group consisting of beryllia, diamond, and boron nitride; said ferromagnetic disks are of iron; and said spacer elements are of a material selected from the group consisting of dispersion-strengthened copper and a nickel-copper alloy.

6. A method for securing a helical slow-wave structure for a traveling-wave tube within an enveloping structure comprising the steps of:

attaching at least three longitudinally disposed dielectric rods to the outer circumferential surface of said helical slow-wave structure at equally spaced circumferential locations therealong to form a subassembly, mounting said subassembly within an enveloping structure comprising a plurality of annular non-magnetic spacer elements respectively interposed between and abutting a plurality of annular ferromagnetic disks, said spacer elements and said disks being coaxially disposed with the inner surfaces of said spacer elements and said disks defining a cylindrical surface of a diameter sufficient to receive said subassembly in a light press-fit relationship, and applying plastically deforming force to the outer surface of said spacer elements to crimp said spacer elements onto said dielectric rods and thereby firmly hold said subassembly within said enveloping structure.

7. A method according to claim 6 wherein said dielectric rods are attached to said slow-wave structure by means of glue which is removed after the plastic deformation step.

8. A method according to claim 6 wherein said dielectric rods have a substantially rectangular cross-section.

9. A method according to claim 6 wherein said spacer elements and said ferromagnetic disks are brazed to one another.

10. A method according to claim 6 wherein said slow-wave structure is of tungsten; said dielectric rods are of a material selected from the group consisting of beryllia, diamond, and boron nitride; said ferromagentic disks are of iron; and said spacer elements are of a material selected from the group consisting of dispersion-strengthened copper and a nickel-copper alloy.

11. A method for securing a helical slow-wave structure for a traveling-wave tube within an enveloping structure comprising the steps of:

attaching four longitudinally disposed dielectric rods to the outer circumferential surface of said helical slow-wave structure at equally spaced circumferential locations therealong to form a subassembly, mounting said subassembly within an enveloping structure comprising a plurality of annular non-magnetic spacer elements respectively interposed between and abutting a plurality of annular ferromagnetic disks, said spacer elements and said disks being coaxially disposed with the inner surfaces of said spacer elements and said disks defining a cylindrical surface of a diameter sufficient to receive said subassembly in a light press-fit relationship, inserting the assembly comprising said subassembly mounted within said enveloping structure between a pair of dies having opposing tool surfaces adapted to contact portions of the outer circumferential surfaces of said spacer elements and apply thereto radially inwardly directed force along directions through respective pairs of said dielectric rods disposed about said helical slow-wave structure at opposite circumferential locations, and contracting said dies to apply plastically deforming force to said spacer elements to crimp said spacer elements onto said dielectric rods and thereby firmly hold said subassembly within said enveloping structure.

12. A method according to claim 11 wherein said dielectric rods are attached to said slow-wave structure by means of glue which is removed after the plastic deformation step.

13. A method according to claim 11 wherein said dielectric rods have a substantially rectangular cross-section.

14. A method according to claim 11 wherein said spacer elements and said ferromagnetic disks are brazed to one another.

15. A method according to claim 11 wherein said slow-wave structure is of tungsten, said dielectric rods are of a material selected from the group consisting of beryllia, diamond, and boron nitride; said ferromagnetic disks are of iron; and said spacer elements are of a material selected from the group consisting of dispersion-strengthened copper and a nickel-copper alloy.

* * * * *

UNITED STATES PATENT AND TRADEMARK OFFICE

CERTIFICATE OF CORRECTION

PATENT NO. : 4,712,293

DATED : December 15, 1987

INVENTOR(S) : Arthur E. Manoly

It is certified that error appears in the above-identified patent and that said Letters Patent is hereby corrected as shown below:

Column 2, line 28, delete "now abandoned".

Signed and Sealed this

Second Day of August, 1988

*Attest:*

*Attesting Officer*

DONALD J. QUIGG

*Commissioner of Patents and Trademarks*